United States Patent [19]

Padarev et al.

[11] Patent Number: 4,646,794

[45] Date of Patent: Mar. 3, 1987

[54] TELESCOPIC ROTARY REFUELING SYSTEM FOR BATTLE TANK

[75] Inventors: Nikolay K. Padarev, Mayfield Heights; Dennis W. Simpson, Kirtland, both of Ohio

[73] Assignee: Universal Hydraulics, Inc., Willoughby, Ohio

[21] Appl. No.: 763,916

[22] Filed: Aug. 8, 1985

[51] Int. Cl.[4] ..... B65B 3/04

[52] U.S. Cl. ..... 141/1; 141/46; 141/387

[58] Field of Search ..... 141/348, 37–66, 141/382–389, 1–12

[56] References Cited

U.S. PATENT DOCUMENTS

| | | | |
|---|---|---|---|
| Re. 27,343 | 4/1972 | Jameson | 141/387 |
| 1,515,844 | 11/1924 | Dorris | 141/392 |
| 4,093,003 | 6/1978 | Miller et al. | 141/279 |
| 4,468,166 | 8/1984 | Jameson | 141/387 |
| 4,540,144 | 9/1985 | Perrella | 141/46 |

*Primary Examiner*—Houston S. Bell, Jr.

*Attorney, Agent, or Firm*—Renner, Otto, Boisselle & Lyon

[57] ABSTRACT

A refueling system is characterized by the delivery of fuel through a multi-stage telescoping cylinder assembly which uses the fuel as the pressure media for extending and retracting the cylinder assembly. Provision also is made for rotating or pivoting the cylinder assembly about two orthogonal axes which, when combined with telescopic extension and retraction of the cylinder assembly, enables a normally closed nozzle connected to the forward end of the innermost piston cylinder to be positionally directed to the fuel inlet portion of the combat vehicle to be refueled. Another attribute of the system is that when properly seated in the fuel inlet port, the nozzle automatically opens.

22 Claims, 5 Drawing Figures

TELESCOPIC ROTARY REFUELING SYSTEM FOR BATTLE TANK

DISCLOSURE

The invention herein disclosed relates generally to a refueling system for battle tanks or other combat vehicles.

BACKGROUND

Refueling of combat vehicles such as battle tanks heretofore has been accomplished by a man carrying a hose from the refueling vehicle or station to the combat vehicle. A problem with this procedure is that under combat comditions the man would be exposed to enemy gunfire. It therefore would be advantageous to provide a refueling system which would enable a man to perform the refueling operation while being protected from enemy gunfire.

SUMMARY OF THE INVENTION

The present invention provides a refueling system for combat vehicles that avoids the prior practice of manually carrying a hose from the refueling vehicle or station to the combat vehicle. The system according to the invention is characterized by the delivery of fuel through a multi-stage telescoping cylinder assembly which uses the fuel as the pressure media for extending and retracting the cylinder assembly. Provision also is made for rotating or pivoting the cylinder assembly about two orthogonal axes which, when combined with telescopic extension and retraction of the cylinder assembly, enables a normally closed nozzle connected to the forward end of the innermost piston cylinder to be positionally directed to the fuel inlet port of the combat vehicle to be refueled. Another attribute of the system is that when properly seated in the fuel inlet port, the nozzle opens automatically.

According to one aspect of the invention, a refueling sytem for combat vehicles comprises a telescopic cylinder assembly including an outer cylinder and an inner piston cylinder mounted within the outer cylinder in telescoping relationship for forward extension and rearward retraction. The outer and inner cylinders form interiorly thereof a fuel delivery passage extending from the rear end to the forward end of the cylinder assembly. A nozzle at the forward end of the inner cylinder includes a fuel dispensing passage in fluid communication with the forward end of the fuel delivery passage and valve means normally closing the fuel delivery passage. The system further comprises fuel porting means for delivering fuel under pressure to the rearward end of the fuel delivery passage for flow through such passage and then through the fuel dispensing passage when the valve means is open, and means for using the delivered fuel as a pressure fluid media to effect extension of the inner cylinder.

According to another aspect of the invention, a refueling system for combat vehicles comprises a base, a turret mounted to the base for rotational movement about a fixed axis, and a telescopic cylinder assembly including an outer cylinder and an inner cylinder mounted within the outer cylinder in telescoping relationship for forward extension and rearward retraction, the outer and inner cylinders forming interiorly thereof a fuel delivery passage extending from the rear end to the forward end of the cylinder assembly. The system further comprises a pivot means for attaching the rearward end of the outer cylinder to the turret for pivotal movement about a second axis generally at right angles to the first axis, fuel porting means for delivering fuel to the rear end of the fuel delivery passage, and a nozzle at the forward end of the inner cylinder for dispensing fuel from the fuel delivery passage to the combat vehicle. The system still further comprises a first actuator for rotatably moving the turret about the first axis, a second actuator for pivotally moving the cylinder assembly about the second axis, and means for effecting extension and retraction of the inner cylinder.

According to a further aspect of the invention, a refueling system for combat vehicles comprises a telescopic cylinder assembly including an outer cylinder and first and second stage piston cylinders mounted within the outer cylinder in telescoping relationship for forward extension and rearward retraction, the second stage cylinder having an axial passage forming with the piston bores of the outer and first stage cylinders a fuel delivery passage extending axially from the rearward end to the forward end of the cylinder assembly. A nozzle at the forward end of the inner cylinder includes a fuel dispensing passage in fluid communication with the forward end of the fuel delivery passage and valve means normally closing the fuel delivery passage. Each of the first and second stage cylinders has a piston head at its rearward end, and each piston head has a first facing surface for fluid pressure to act against to effect extension of the respective cylinder and a second facing surface for fluid pressure to act against to effect retraction of the respective cylinder. Each first facing surface is in fluid communication with the rearward end of the fuel delivery passage and each second facing surface is isolated from such fluid delivery passage. The system also includes first porting means for delivering fuel under pressure to the rear end of the fuel delivery passage for contact with each first facing surface to effect extension of the first and second stage cylinders and also for passage through the fuel delivery passage and fuel dispensing passage when the valve is open, and second porting means for delivering fuel under pressure into contact with each second facing surface to effect retraction of the first and second stage cylinders.

The invention also provides a method of refueling a combat vehicle comprising the steps of positionally locating a nozzle attached to one end of a telescopic cylinder assembly at a fuel inlet port of the combat vehicle by extending and/or retracing the cylinder assembly with fuel delivered under pressure to such assembly being used as a fluid pressure media to effect such extension and retraction, and then delivering fuel interiorly through the cylinder assembly to the nozzle for dispensing by such nozzle into the fuel inlet port of the combat vehicle.

The foregoing and other features of the invention are hereinafter more fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
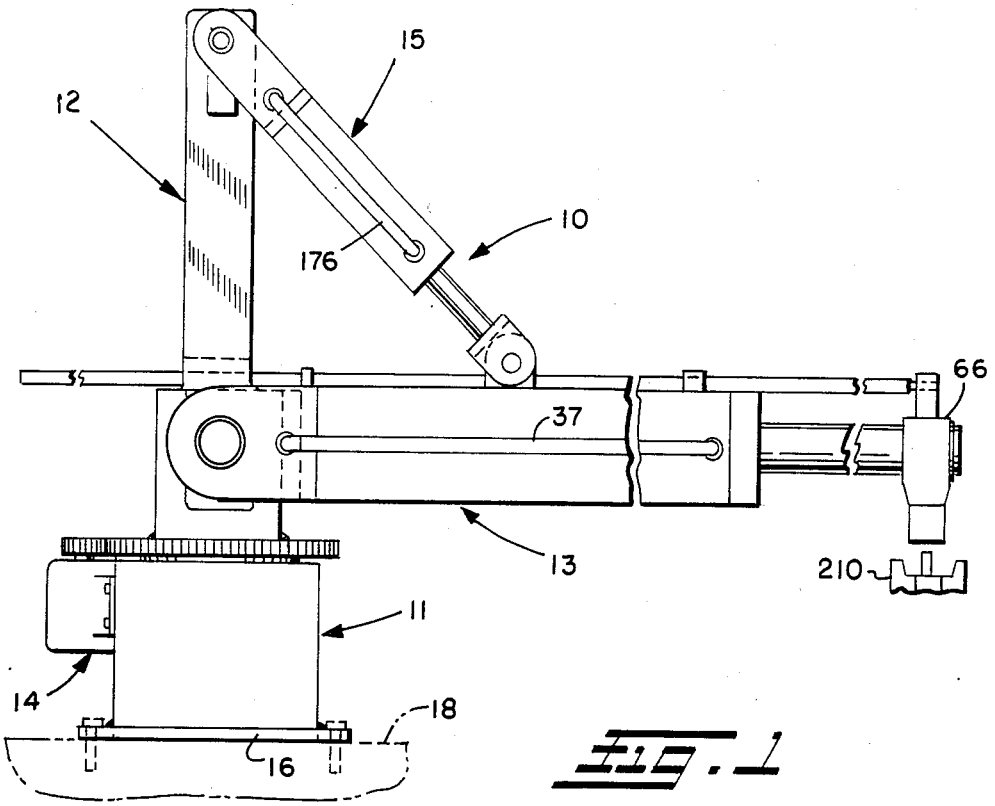
FIG. 1 is a side elevational view of a refueling system according to the present invention.

Referring now in detail to the drawings and initially to FIG. 1, there is generally indicated at 10 a preferred embodiment of a refueling system according to the present invention. The refueling system 10 generally comprises a base 11, a turret 12 swivel mounted for rotation in the base about a vertical axis, a telescopic cylinder assembly 13 pivotally connected at its rearward end to the turret for pivotal movement about a horizontal axis intersecting the rotational axis of the turret, a turret drive 14 for turining the turret in the base, and a lift actuator 15 for pivotally raising and lowering the cylinder assembly. The refueling system preferably is used in combination with a refueling vehicle and, as shown, the base 11 has a bottom mounting flange 16 by which it may be fixedly mounted by fasteners 17 to the vehicle which is only partly shown in phantom lines at 18. The refueling vehicle 18 may be of conventional type including a fuel pump operably connected to a fuel tank or tanks carried by the vehicle. The vehicle also may include a cab in which controls for remotely operating the refueling system may be located and which may be protected by armor.

Figures 2, 3:
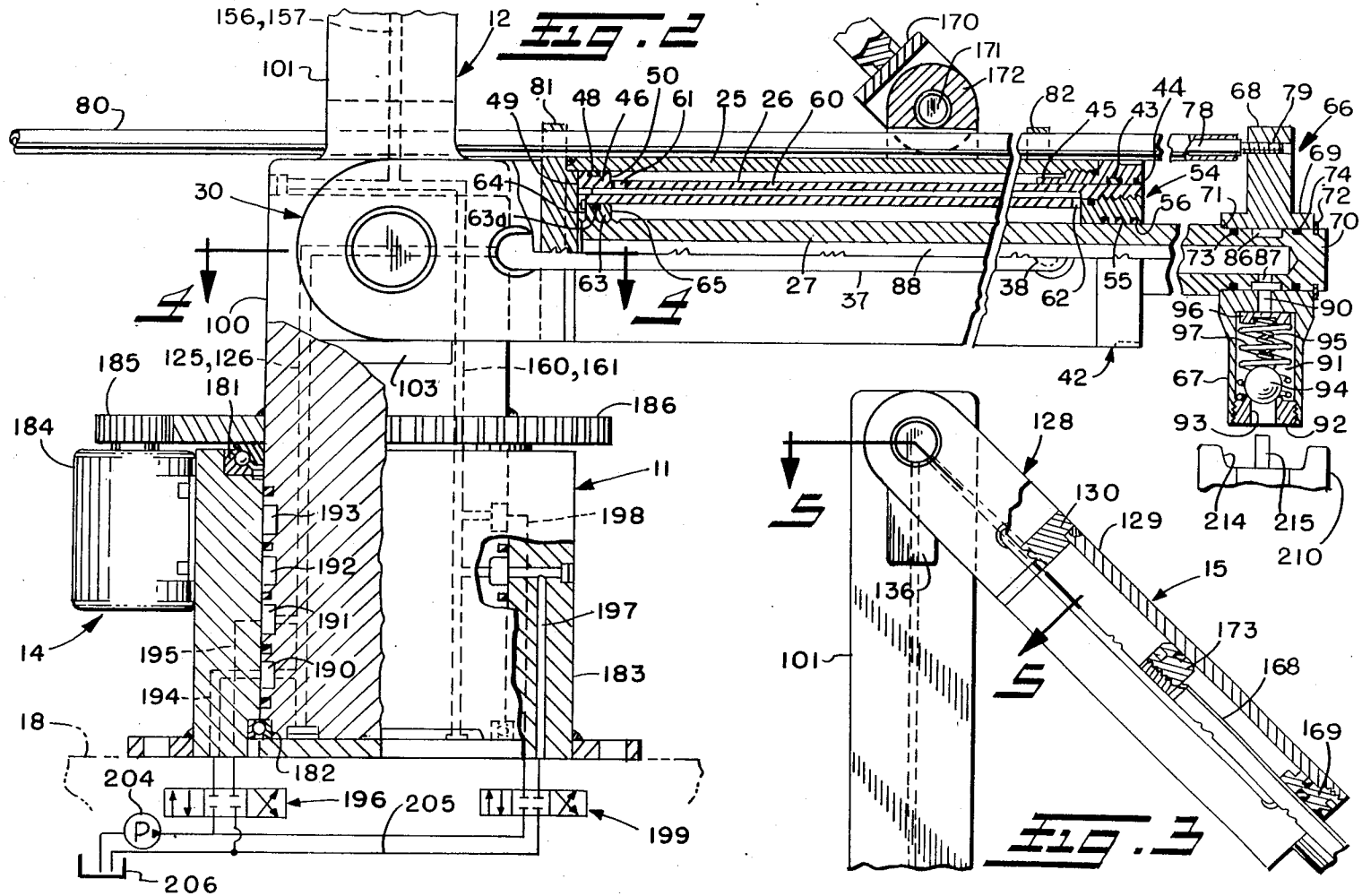
FIGS. 2 and 3 respectively are lower and upper broken continuations of an enlarged side elevational view, partly broken away in section, of the refueling system illustrated in FIG. 1.

In FIG. 2, the telescopic cylinder assembly 13 can be seen to comprise an outer cylinder 25, an intermediate or first stage piston cylinder 26 and an inner or second stage piston cylinder 27. The cylinders are hollow tubes of progressively descreasing diameter and the first stage cylinder 26 and second stage cylinder 27 are mounted within the outer cylinder 25 in coaxial telescoping relationship for extension in a forward direction away from the base 11 and retraction in a rearward direction towards the base.

Figure 4:
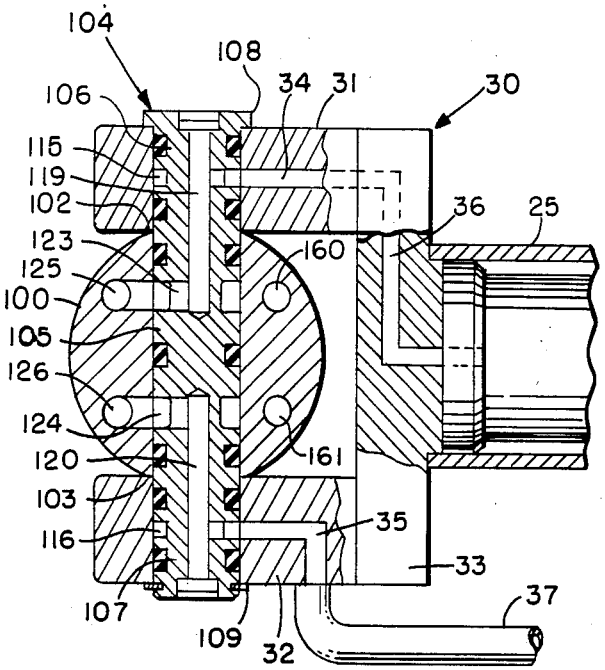
FIG. 4 is an enlarged sectional view taken substantially along the line 4—4 of FIG. 2.

The outer cylinder 25, at its rearwardmost end, is attached as by welding or other suitable means to a clevis-shaped end piece 30 which is pivotally attached to the turret 12. As seen in FIG. 4, the end piece or clevis 30 includes transversely spaced, parallel clevis arms 31 and 32 and a yoke plate 33 to which the outer cylinder is centrally attached. The clevis arms 31 and 32 include respective passages 34 and 35 to which fuel, such as diesel fuel, may be selectively supplied under pressure while the other passage is connected to a fuel return. The passage 34 is connected by a passage 36 in the yoke plate 33 to the interior or piston bore of the outer cylinder 25 at the rearwardmost end and center axis of such cylinder. The passage 35 also is connected to the piston bore of the outer cylinder but near its forwardmost end by external tubing 37 which extends along the outside of the outer cylinder 25 to a radial passage 38 in the wall of the outer cylinder.

At the forwardmost end of the outer cylinder 25, an annular stuffing box 42 is mounted as in the manner shown in FIG. 2. The stuffing box laterally supports the first stage cylinder 26 at the forward end of the outer cylinder while permitting telescopic extension and retraction of the first stage cylinder, and an annular seal 43 and wiper 44 are included in the stuffing box to effect a seal with the outer cylindrical surface of the first stage cylinder. The stuffing box also has a rearwardly extending annular stop flange 45 against which a piston head 46 on the first stage cylinder 26 will abut to limit extension of the first stage cylinder. The stop flange 45 is at least partly coextensive with the hole 38 in the wall of the outer cylinder thereby to stop the piston head 46 rearwardly of a point which would close the hole 38. The outer diameter of the stop flange is less than the inner diameter of the outer cylinder so as to form therebetween an annular space which is in fluid communication with the hole 38 and hence with the external tubing 37 and the passage 35 in the end piece 30.

The piston head 46, located at the rearward end of the first stage cylinder 26, has an annular groove which retains an annular seal 48 that provides a sliding seal between the piston head and the inner diameter surface of the outer cylinder 25. The piston head also has a first facing surface 49 at its rearward end and a second facing surface 50 at its forward end.

At its forward end, the first stage cylinder 26 is counterbored and threaded for screw-in mounting of an annular stuffing box 54. As seen in FIG. 2, the forwardmost end face of the stuffing box 54 may be flush with the forwardmost end face of the first stage cylinder which in turn may be flush with the forwardmost end face of the outer cylinder's stuffing box 42 when the first stage cylinder is fully retracted into the outer cylinder. The stuffing box 54 laterally supports the second stage cylinder 27 while permitting telescopic movement of the second stage cylinder, and an annular seal 55 and wiper 56 are included in the sutffing box 54 to provide a seal between the stuffing box and the outer diameter surface of the second stage cylinder 27.

For a purpose that will become apparent from the following description, the first stage cylinder 26 has in the cylindrical wall thereof an axially extending passage 60 which terminates short of or is otherwise closed at the axial ends of the first stage cylinder. The rearward end of the passage 60 is connected to a radial passage 61 which opens to the outer diameter surface of the first stage cylinder at a point forwardly adjacent the second facing surface 50 of the piston head 46. At its forward end, the passage 60 is connected to another radial passage 62 which opens to the inner diameter surface of the first stage cylinder at a point rearwardly adjacent the stuffing box 54.

The second stage cylinder 27 also is provided with a piston head 63 at its rearward end. The piston head 63 has a first facing surface 64 at its rearward side and a second facing surface 65 at its forward side. The piston head also has an annular groove for an annular seal 63a which provides a sliding seal between the pisotn head 63 and the inner diameter surface of the first stage cylinder 26.

At its forward end, the second stage cylinder 27 has mounted thereon a nozzle 66. The nozzle 66 has a nozzle end portion 67 and an arm portion 68 which radiate in opposite directions from a hub portion 69. The hub portion 69 is supported on a slightly reduced diameter end portion 70 of the second stage cylinder which forms a shoulder 71 and the hub portion 69 is axially trapped between the shoulder 71 and a retaining ring 72. The reduced diameter end portion 70 of the second stage cylinder includes a pair of annular grooves in which annular seals 73 and 74 are retained to provide a seal between such reduced diameter end portion and the inner diameter surface of the nozzle hub 69.

Although the nozzle 66 is thusly supported on the second stage cylinder 27 for relative rotation, the nozzle is maintained at a predetermined orientation relative to the outer cylinder 25 by a guide rod 78 fixed at its forward threaded end 79 to the radial arm 68 of the nozzle. The guide rod 78 is supported for longitudinal movement in a guide tube 80 which extends parallel to the axis of the telescopic cylinder assembly 13. The guide tube 80 is held stationary with respect to the outermost tube 25 by mounting elements 81 and 82 and passes through an aperture 83 in the turret 12. A telescopic guide rod may be used in the alternative.

As seen in FIG. 2, the seals 73 and 74 are axially spaced apart at respective sides of an annular groove 86 in the reduced diameter end portion 70 of the second stage cylinder 27. This groove 86 is connected by a radial passage 87 to a fuel delivery passage 88 extending axially through the second stage cylinder. Such passage 88 opens to the rearwardmost end face of the second stage cylinder 27 and extends to the closed forward end of such cylinder. When the first and second stage cylinders are extended, the piston bores of the outer and first stage cylinders form a continuation of the fuel delivery passage 88 extending from the rear end of the outer cylinder's piston bore the nozzle 66.

The groove 86 is radially outwardly closed by the hub portion 69 of the nozzle 66 which is provided with a radial passage 90 through which fuel can flow from the fuel delivery passage 88 and into a cylindrical fuel dispensing passage 91 in the nozzle outlet end portion 67.

The nozzle outlet end portion 67 is tubular and at its distal end there is mounted a valve seat member 92. The valve seat member 92 has a central through port 93 which is normally closed by a ball check valve 94 which is urged against the valve seat member by a spring 95. The spring 95 is disposed between the ball valve 94 and a spring retaining disc 96 which is held against the bottom wall of the fuel dispensing passage by another spring 97 which is disposed between the spring retaining disc 96 and the valve seat member 92. Any fuel under pressure in the fuel dispensing passage 91 also will serve to hold the ball valve 93 against the valve seat member 92 to prevent the escape of such fuel through the outlet port 93.

Turning now to the turret 12, such can be seen in FIGS. 2 and 4 to have a cylindrical main body portion 100 and a cylindrical tower portion 101 of smaller diameter. The cylindrical turret body 100, which is mounted in the base 11 for rotation about its axis, has an upper portion above the base which is provided with diametrically opposed, parallel flats 102 and 103. At the flats 102 and 103, the clevis arms 31 and 32 of the telescopic cylinder assembly end piece 30 straddle the turret body for pivotal attachment by a ported clevis pin 104. The clevis pin 104 passes through a cylindrical, diametral bore in the turret body which is perpendicular to the flats. The pin also extends beyond the flats to support the clevis arms at a cylindrical bores therein which are coaxial with the bore in the turret body. Accordingly, the pin has a middle portion 105 supported for rotation in the turret body and opposite end portions 106 and 107 supporting respective clevis arms 31 and 32 for relative rotation about the axis of the pin 104. As shown, the pin may be retained in place by an integral head 108 at one end and a retaining clip 109 at the other end.

The pin end portions 106 and 107 respectively located in the clevis arms 31 and 32 are provided with respective annular grooves 115 and 116 which are in fluid communication with the clevis arm passages 34 and 35, respectively. The grooves 115 and 116 are connected by radial pin passages to respective axial pin passages 119 and 120. The axial pin passages 119 and 120 are connected by respective radial passages to respective annular grooves 123 and 124 in the middle pin portion 105 located within the turret body 100, and such grooves 123 and 124 are in fluid communication with respective passages 125 and 126 in the turret body. As shown, the grooves 115, 116, 123 and 124 are spaced apart along the axis of the pin and annular seals are provided to prevent external leakage and cross flow between the grooves. As will become apparent from the following description, the passage 125 may be referred to as a telescopic cylinder assembly extend passage and the passage 126 may be referred to as a telescopic cylinder assembly retract passage.

Figure 5:
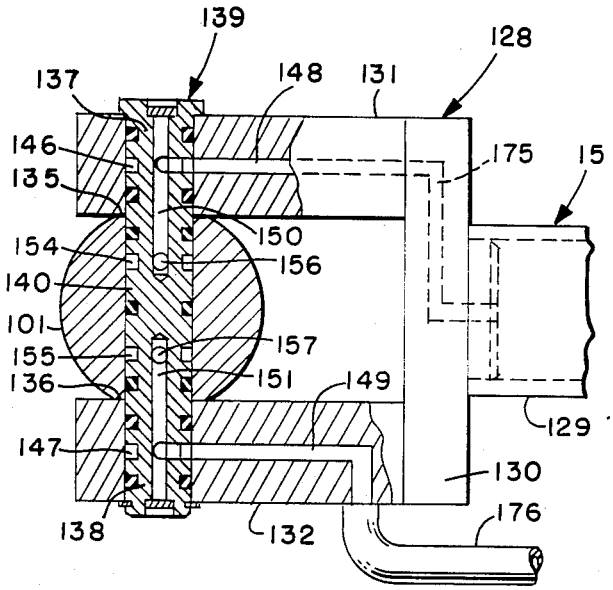
FIG. 5 is an enlarged sectional view taken substantially along the line 5—5 of FIG. 3.

In FIGS. 3 and 5, it will be seen that a similar clevis pin/hydraulic swivel connection is provided to pivotally connect a clevis-shaped end piece 128 of the lift actuator 15 to the upper end of the turret tower 101 as well as to port fluid to and from the lift actuator 15. The lift actuator, which may be a piston-cylinder assembly of conventional type, has the rearward/upward end of its cylinder 129 centrally connected as by welding to the yoke plate 130 of the end piece. The clevis arms 131 and 132 of the end piece straddle the turret tower 101 at parallel flats 135 and 136 at respective diametrically opposed sides of the turret tower. The clevis arm 131 and 132 are supported at bores therein on respective end portions 137 and 138 of a ported clevis pin 139 which has a middle portion 140 supported in a diametral bore in the turret tower 101.

The pin end portions 137 and 138 are provided with respective annular grooves 146 and 147 which are in fluid communication wtih respective passages 148 and 149 provided in the clevis arms 131 and 132, respectively. The grooves 146 and 147 are connected by radial passages to respective axial pin passages 150 and 151. The axial pin passages 150 and 151 are connected by respective radial passages to respective annular grooves 154 and 155 in the pin middle portion 140 located in the turret tower 100. The grooves 154 and 155 in turn are in fluid communication with respective passages 156 and 157 in the turret tower.

The passages 156 and 157 extend longitudinally downwardly through the turret tower 101 to respective laterally extending passages for connection to respective longitudinally extending passages 160 and 161 in the turret body 100. As seen in FIGS. 2 and 4, the passages 160 and 161 are forwardly offset in the turret body to clear the bore for the clevis pin 104. For reasons that will become apparent from the following description, the passage 160 may be referred to as a lift cylinder extend passage and the passage 161 may be referred to as a lift cylinder retract passage.

In FIG. 3, the lift actuator 15 includes, in addition to the cylinder 129, a piston rod 168 which is supported for axial sliding movement in a stuffing box 169 mounted in the forward end of the cylinder 129. At its rod end seen in FIG. 2, the piston rod 168 is pivotally connected by a clevis 170 and clevis pin 171 to an attachment lug 172 fixed to the top side of the outer cylinder 25 of the telescopic cylinder assembly 13 at a point located forwardly of the pivot or swing axis of the telescopic cylinder assembly 13. As is conventional, the piston rod has a piston head 173 movable axially within the interior bore of the cylinder 129. The interior bore or piston chamber of the cylinder 129 is in fluid communication at its rearward end with the clevis arm passage 148 via a laterally extending yoke passage 175 and its forward end with the clevis arm passage 149 via external tubing 176.

Looking now at the bottom of FIG. 2, it can be seen that the turret 100 at a lower portion of its cylindrical main body 100 is supported for rotation about its axis by upper and lower bearings 181 and 182 in the cylindrical wall 183 of the base. Rotation of the turret about its axis is effected by the turret drive 14 which, in the illustrated embodiment, includes an LSHT hydraulic motor 184. Mounted on the drive shaft of the hydraulic motor is a pinoin 185 which meshes with a gear 186 which is concentrically attached as by welding to the outer diameter of turret body 100 at the upper end of the cylindrical base wall 183. The hydraulic motor 184 may be connected in conventional manner to a hydraulic pump located in the vehicle 18 to which the refueling system is mounted with suitable hydraulic controls being provided to control operation of the hydraulic motor and hence turning or swiveling movement of the turret about its axis.

The lower portion of the turret body 100, which has a diameter closely corresponding to the inner diameter of the base wall 183, is provided with four axially spaced part annular grooves 190–193 at its outer diameter. The groove 190 is connected by a radial passage to the axial passage 125; the groove 191 is connected by a radial passage to the axial passage 126; the groove 192 is connected by a radial passage to the axial passage 161; and the groove 193 is connected to the axial passage 160. Also, as schematically indicated, the grooves 190 and 191 are in fluid communication with respective passages 194 and 195 in the cylindrical base wall 183 which are connected by suitable means to a telescopic cylinder assembly control valve 196 provided, for example, in the vehicle 18. The grooves 192 and 193 also are in fluid communication with respective passages 197 and 198 in the cylindrical base wall 183 which are connected by suitable means to lift actuator control valve 199. The fluid connections between the grooves and the passages in the cylindrical base wall 183 are sealed against cross flow and external leakage by annular seals retained in grooves in the lower portion of the turret body as seen in FIG. 2.

As schematically shown, the cylinder assembly control valve 196 is operable to selectively connect either of the passages 194 and 195 to a hydrualic fuel pump 204 with the other being connected to a fuel return line 205 leading to the fuel tank or tanks 206 in the vehicle 18. In the illustrated embodiment, the lift actuator control valve 199 also is operable to selectively connect either of the passages 197 and 198 to the hydraulic pump 204 with the other passage being connected to the fuel return line 205. The pump preferably is a two stage pump installed in the reservoir 206 for a flooded inlet condition.

In operation of the refueling system 10, initially the vehicle 18 and combat vehicle to be refueled are relatively maneuvered to position the combat vehicle's fuel inlet port, an exemplary one being shown at 210 in FIGS. 1 and 2, within reach of the telescopic cylinder assembly 13. The telescopic cylinder assembly 13 then may be extended, pivoted up and down, and/or swung right and left to direct the nozzle 66 to an into seated engagement with the fuel inlet port 210 of the combat vehicle. Swinging of the telescopic cylinder assembly is effected by operating the hydraulic motor 184 to turn the turret 100 in the base 11 whereas extension and retraction and upward and downward pivoting of the telescopic cylinder assembly are effected in the below discussed manner.

To extend the piston-cylinder assembly 13, the cylinder assembly control valve 196, which may have a null position, is moved to an extend position to connect the hydraulic pump 204 to the turret passage 125 via the base passage 194. Fuel supplied under pressure by the pump will be directed through the ported clevis pin 104 to the rearwardmost end of the interior or piston bore of the outer cylinder 25. The pressurized fuel will act upon the first facing surfaces 49 and 64 of the first and second stage cylinder piston heads (also the rearward axial end faces of the cylinders) and exert sufficient force to move forwardly the first and second stage cylinders to effect their extension. The first stage cylinder 26 will extend until its piston head 46 abuts the stroke limiting flange 45 of the stuffing box 42 and the second stage cylinder 27 will extend until its piston head 63 engages the stuffing box 54 at the forward end of the first stage cylinder.

During the forward stroke of the first stage cylinder 26, fuel in the annular space between the first stage cylinder and the outer cylinder 25 will drain via the external piping 37 to the ported clevis pin 104 where such fluid is directed to the turret passage 126. From the turret passage 126, such fuel will flow via the base passage 195 to the cylinder assembly control valve 196 where such fluid is directed to the fuel return line 205 for passage back into the fuel tank 206. It also is noted that during extension of the second stage cylinder 27 relative to the first stage cylinder 26, fuel in the annular space between the first and second stage cylinders will be ported via the first stage cylinder passage 60 to the annular space between the first stage cylinder and the outer cylinder for return to the fuel tank 206 in the above indicated manner. At any time, the cylinder assembly control valve 196 may be moved, for example, to a null position to stop extension of the telescopic cylinder assembly or to its retract position to retract the cylinder assembly.

When the control valve 196 is in its retract position, the hydraulic pump 204 is connected to the turret passage 126 and the turret passage 125 is connected to the fuel return line 205. Accordingly, pressurized fuel will act upon the second facing surfaces 50 and 65 of the first and second stage cylinders 26 and 27 and exert sufficient force to move rearwardly the first and second stage cylinders to effect their retraction, while fluid in front of the first facing surfaces is returned to the fuel tank through the system's internal porting.

To effect upward pivoting of the telescopic cylinder assembly 13, the lift actuator control valve 199 may be shifted as from a null position to its retract position to direct fuel from the pump 204 to the turret passage 161 via the base passage 197. From the turret passage 161, the pressurized fuel will flow through the clevis pin 139 to the retract side of the piston head 173 of the lift actuator 15 via external tubing 176. The pressurized fuel will act upon the piston head 173 with sufficient force to retract the piston rod 168 relative to the lift cylinder 134 to effect upward pivoting of the telescopic cylinder assembly 13. As the piston rod 168 is being retracted, fuel at the extend side of the piston head 173 will be ported through the clevis pin 104 to the turret passage 160 and from the passage 160 via the base passage 198 to the control valve 199 where it is directed back to the fuel tank 206.

To pivot the telescopic cylinder assembly downwardly, the control valve 199 may be shifted to its extend position to connect the fuel pump 204 to the base passage 198. From the base passage 198, the pressurized fuel will flow through the turret passage 160 and clevis pin 104 to the extend side of the piston head 173 of the lift actuator 15. The pressurized fuel will act against the piston head with sufficient force to extend the piston rod 168 to downwardly pivot the telescopic cylinder assembly 13. During such extension of the piston rod 168, fuel at the retract side of the piston head 173 will flow via the external tubing 176 and respective passages in the clevis pin 139 to the turret passage 161. From the turret passage 161, the fuel will flow via the base passage 197 to the control valve 199 which directs the fuel to the fuel tank 206.

In view of the foregoing, the telescopic cylinder assembly may be controllably rotated or pivoted about two orthogonal axes and also extended and retracted positionally to locate the nozzle at the combat vehicle's fuel inlet port. Importantly, such control may be effected by a man located in the refueling vehicle which may be armored to protect its occupants and contents from enemy gunfire. Moreover, the fuel is used as the pressure media to actuate hydraulically the telescoping elements of the system. One advantage of this is the avoidance of the problem of contamination of fuel and hydraulic oil by the other and also the ability to use the piston bores of the outer cylinders of the telescoping assembly as an internal fuel delivery passage extending from one end of the telescoping assembly to the other.

To effect coupling of the nozzle 66 to the fuel inlet port 210 of the combat vehicle, the telescopic cylinder assembly 13 may be extended and pivoted to locate the nozzle 66 at a position from which it may be swung downwardly into the fuel inlet port. The fuel inlet port may have a tapered entry 214 for guiding the nozzle into a desired positional relationship during final downward swinging of the nozzle. The fuel inlet port also may be provided with an upwardly projecting center pin 215 which passes through the outlet port 93 and engages the ball valve 94 automatically to unseat the same from the valve seat 91 as the nozzle is lowered into the fuel inlet port.

Although the invention has been shown and described with respect to a preferred embodiment and orientation, equivalent alterations and modifications may occur to others skilled in the art upon the reading and understanding of the specification. The present invention includes all such equivalent alterations and modifications, and is limited only by the scope of the following claims.

What is claimed is:

1. A refueling system for combat vehicles comprising a telescopic cylinder assembly including an outer cylinder and an inner piston cylinder mounted within said outer cylinder in telescoping relationship for forward extension and rearward retraction, said outer and inner cylinders forming interiorly thereof a fuel delivery passage extending from the rear end to the forward end of said cylinder assembly; a nozzle attached to the forward end of said inner cylinder for movement therewith, said nozzle including a fuel dispensing passage in fluid communication with the forward end of said fuel delivery passage and valve means normally closing said fuel delivery passage; fuel porting means for delivering fuel under pressure to the rearward end of said fuel delivery passage for flow through such passage and then through said fuel dispensing passage when said valve means is open; and means for using such delivered fuel as a pressure fluid media to effect extension of said inner cylinder, said outer cylinder having a piston bore, and said inner cylinder having at its rearward end a piston head axially movable in said piston bore and an axial passage forming with said piston bore said fuel delivery passage.

2. A system as set forth in claim 1, wherein said piston head has first facing means for fluid pressure to act against to effect extension of said inner cylinder, said first facing means is in fluid communication with said fuel delivery passage whereby fuel delivered under pressure to said fuel delivery passage will contact said first facing means to effect extension of said inner cylinder.

3. A system as set forth in claim 2, wherein said piston head has second facing means for fluid pressure to act against to effect retraction of said inner cylinder, and further comprising means for delivering fuel under pressure into contact with said second facing means to effect retraction of said inner cylinder.

4. A system as set forth in claim 1, wherein said valve means is automatically opened upon engagement of said nozzle with the fuel inlet port of the vehicle being refueled.

5. A system as set forth in claim 1, further comprising a support member and pivot means attaching the rearward end of said outer cylinder to said support member for pivotal movement of said outer cylinder relative to said support member.

6. A refueling system for combat vehicles comprising a telescopic cylinder assembly including an outer cylinder and an inner piston cylinder mounted within said outer cylinder in telescoping relationship for forward extension and rearward retraction, said outer and inner cylinders forming interiorly thereof a fuel delivery passage extending from the rear end to the forward end of said cylinder assembly; a nozzle at the forward end of said inner cylinder, said nozzle including a fuel dispensing passage in fluid communication with the forward end of said fuel delivery passage and valve means normally closing said fuel delivery passage; fuel porting means for delivering fuel under pressure to the rearward end of said fuel delivery passage for flow through such passage and then through said fuel dispensing passage when said valve means is open; means for using such delivered fuel as a pressure fluid media to effect extension of said inner cylinder; a support member; and pivot means attaching the rearward end of said outer cylinder to said support member for pivotal movement of said outer cylinder relative to said support member, said pivot means including a hydraulic swivel through which fuel is ported for delivery to said cylinder assembly.

7. A system as set forth in claim 6, further comprising piston-cylinder means connected between said outer cyinder and said support for pivotally moving said outer cylinder relative to said support.

8. A system as set forth in claim 7, further comprising hydraulic swivel means for pivotally connecting one end of said piston-cylinder means to said support and for delivering pressure media to and from said piston-cylinder means for extension and retraction.

9. A system as set forth in claim 8, wherein said pressure media is fuel.

10. A system as set forth in claim 8, further comprising a base in which said support is mounted for rotational movement about an axis generally perpendicular to the pivot axis of said outer cylinder.

11. A system as set forth in claim 10, wherein said base includes fluid passages in fluid communication with respective fluid passages in said support through which the fuel and pressure media is delivered to and from said telescoping cylinder assembly and piston-cylinder assembly respectively via said hydraulic swivel and hydraulic swivel means.

12. A system as set forth in claim 6, wherein said hydraulic swivel includes a ported clevis secured to said outer cylinder and a ported clevis pin attaching said ported clevis to said support.

13. A refueling system for combat vehicles comprising a telescopic cylinder assembly including an outer cylinder, and an intermediate piston cylinder and an inner piston cylinder mounted within said outer cylinder in telescoping relationship for forward extension and rearward retraction, said outer, intermediate and inner cylinders forming interiorly thereof a fuel delivery passage extending from the rear end to the forward end of said cylinder assembly; a nozzle at the forward end of said inner cylinder, said nozzle including a fuel dispensing passage in fluid communication with the forward end of said fuel delivery passage and valve means normally closing said fuel delivery passage; fuel porting means for delivering fuel under pressure to the rearward end of said fuel delivery passage for flow through such passage and then through said fuel dispensing passage when said valve means is open; and means for using such delivered fuel as a pressure fluid media to effect extension of said intermediate and inner cylinders.

14. A refueling system for combat vehicles comprising a telescopic cylinder assembly including an outer cylinder and first stage and second stage piston cylinders mounted within said outer cylinder in telescoping relationship for forward extension and rearward retraction, said second stage cylinder having an axial passage forming with the piston bores of said outer and first stage cylinders a fuel delivery passage extending axially from the rearward end to the forward end of said cylinder assembly; a nozzle at the forward end of said second stage cylinder, said nozzle including a fuel dispensing passage in fluid communication with the forward end of said fuel delivery passage and valve means normally closing said fuel delivery passage; each of said first and second stage cylinders having a piston head at its rearward end, each said piston head having first facing means for fluid pressure to act against to effect extension of the respective cylinder and second facing means for fluid pressure to act against to effect retraction of the respective cylinder, and each said first facing means being in fluid communication with the rearward end of said fuel delivery passage and each said second facing surface means being isolated from said fuel delivery passage, first porting means for delivering fuel under pressure to the rear end of said fuel delivery passage for contact with each said first facing means to effect extension of the respective cylinders and also for passage through said fuel delivery passage and fuel dispensing passage when said valve means is open; and second porting means for delivering fuel under pressure into contact with each second facing means to effect retraction of the respective cylinders.

15. A system as set forth in claim 14, wherein said second stage cylinder includes an axial passage for effecting fluid communication between said second facing means of said first and second stage cylinders.

16. A refueling system for combat vehicles comprising a base; a turret mounted to said base for rotational movement about a first axis; a telescopic cylinder assembly including an outer cylinder and an inner cylinder mounted within said outer cylinder in telescoping relationship for forward extension and rearward retraction, said outer and inner cylinders forming interiorly thereof a fuel delivery passage extending from the rear end to the forward end of said cylinder assembly; pivot means for attaching the rearward end of said outer cylinder to said turret for pivotal movement about a second axis generally at right angles to said first axis; fuel porting means for delivering fuel to the rear end of said fuel delivery passage; a nozzle at the forward end of said inner cylinder for dispensing fuel from said fuel delivery passage to the combat vehicle; first actuator means for rotatably moving said turret about said first axis; second actuator means for pivotally moving said cylinder assembly about said second axis; and means for effecting extension and retraction of said inner cylinder.

17. A method of refueling a combat vehicle comprising the steps of positionally locating a nozzle attached to one end of a telescopic cylinder assembly at a fuel inlet port of the combat vehicle by extending and/or retracting the cylinder assembly with fuel delivered under pressure to such assembly being used as a fluid presssure media to effect such extension and retraction, and then delivering fuel interiorly through the cylinder assembly to the nozzle for dispensing by such nozzle into the fuel inlet port of the combat vehicle, said nozzle locating step further including pivoting the cylinder assembly about a first axis fixed relative to a support and pivoting the support about a second axis which is generally perpendicular to the first axis.

18. A method as set forth in claim 17, wherein said nozzle locating step further comprises pivoting the cylinder assembly about a first axis fixed relative to a support, and pivoting the support about a second axis which is generally perpendicular to the first axis.

19. A system as set forth in claim 1, wherein said nozzle is oriented generally at right angles to the extension/retraction axis of said cylinder assembly.

20. A system as set forth in claim 1, wherein said nozzle is mounted to the forward end of said cylinder assembly for rotation relative to said inner cylinder, and guide means are provided generally to maintain said nozzle at a predetermined orientation relative to said outer cylinder.

21. A system as set forth in claim 20, wherein said means to maintain includes a guide rod attached to said nozzle and extending parallel to the axis of said cylinder assembly, and guide means fixed with respect to said outer cylinder for restraining said guide rod to axial movement.

22. A system as set forth in claim 21, wherein said guide means includes a guide tube for supporting said guide rod in telescoping relationship.

* * * * *